US005521043A

United States Patent [19]

Listigovers et al.

[11] Patent Number: 5,521,043

[45] Date of Patent: May 28, 1996

[54] HYDROXYGALLIUM PHTHALOCYANINE PIGMENTS WITH BLOCK COPOLYMER BINDERS

[75] Inventors: Nancy A. Listigovers, Oakville; Charles G. Allen, Waterdown; Trevor I. Martin, Burlington; Gordon K. Hamer, Mississauga; Cheng-Kuo Hsiao, Mississauga; Giuseppa Baranyi, Mississauga, all of Canada

[73] Assignee: Xerox Corporation, Stamford, Conn.

[21] Appl. No.: 435,899

[22] Filed: May 5, 1995

[51] Int. Cl.[6] ..... G03G 5/047; G03G 5/082

[52] U.S. Cl. ..... 430/59; 430/58; 430/96

[58] Field of Search ..... 430/58, 59, 96

[56] References Cited

U.S. PATENT DOCUMENTS

| | | | |
|---|---|---|---|
| 4,265,990 | 5/1981 | Stolka et al. | 430/59 |
| 5,384,222 | 1/1995 | Hermandin et al. | 430/58 |
| 5,384,223 | 1/1995 | Listigovers et al. | 430/59 |
| 5,407,766 | 4/1995 | Mayo et al. | 430/59 X |

*Primary Examiner*—Roland Martin

*Attorney, Agent, or Firm*—E. O. Palazzo

[57] ABSTRACT

A photoconditive imaging member comprised of a supporting substrate, a photogenerating layer comprised of a photogenerating pigment, or photogenerating pigments dispersed in a polystyrene/poly(methacrylic acid) ($A_n$-$B_m$) block copolymer wherein A is the anchoring block, B is the steric stabilizing block, and n and m represent the number of segments; and a charge transport layer.

32 Claims, No Drawings

HYDROXYGALLIUM PHTHALOCYANINE PIGMENTS WITH BLOCK COPOLYMER BINDERS

BACKGROUND OF THE INVENTION

This invention is generally directed to hydroxygallium phthalocyanines and photoconductive-imaging members thereof, and, more specifically, the present invention is directed to polystyrene/poly(methacrylic acid) diblock copolymers that can be selected as dispersant/binder polymers for photogenerating pigments, and more specifically, wherein the aforementioned diblock copolymers can be selected as resin binders for hydroxygallium phthalocyanines, especially Type V hydroxygallium phthalocyanine. The novel diblock copolymers of the present invention are comprised, for example, of an A block that binds to and is anchored to the photogenerating pigment surface, and a B block that functions primarily as a steric stabilizer to prevent, or minimize reflocculation of the photogenerating pigment after dispersion thereof. Examples of A blocks include polysulfonic acids, polyphosphonic acids, polycarboxylic acids, polyphenols, and the like; and B block examples include those blocks that are soluble in the organic solvent selected for preparation of the imaging member, such as polystyrene, poly(styrene-co-butadiene), poly(alkylstyrene), poly(alkyl acrylates), poly(alkyl methacrylates) and copolymers thereof.

To effectively permit coating of the photogenerating layer or binder generator layer (BGL) on the supporting substrate, it is usually necessary to dissolve the polymeric binder in a solvent suitable for coating, and disperse the photogenerator pigment in the solvent/binder mixture. Submicron size pigment particles are desired which often requires extensive grinding of the mixture in a ball mill or attritor. Large pigment particles, due to inefficient grinding or reflocculation, are considered undesirable for most purposes since they result in coating defects which subsequently surface as print defects. Therefore, it is of importance that the dispersion once formed remain stable for a minimum of about 7 to about 14 days to allow completion of the coating. For example, dip coating would require the dispersion to remain stable for a period of months, for example up to seven months. When HOGaPc is dispersed in commercially available binder resins, such as polyvinylbutyral, some settling or flocculation is evident within about 24 hours.

The addition of certain A-B diblock copolymers to a pigment, prior to milling, can provide superior dispersion, reference H. L. Jakubauskas, *Journal of Coatings Tech.*, Vol. 58, No. 736, pages 71 to 82, 1986. The A block acts as an anchor on the pigment surface, while the B block extends out from the surface to provide steric stabilization. However, these types of materials cannot usually be incorporated into the binder generator layer (BGL) without adversely affecting the sensitivity, dark decay and cyclic stability of the resulting photoreceptor device. The block copolymer dispersants of this invention enable excellent imaging member sensitivity, and cyclic stability when compared to control devices, such as photoconductive imaging members with a BMS® polyvinylbutyral binder, or the specific aforementioned diblocks of the prior art.

Advantages achievable with the imaging members of the present invention include excellent photogenerating pigment dispersion at time zero, stable dispersions over time, and excellent flow properties. The A-B block copolymer in embodiments is designed such that the length and composition of the A segment enables it to bind or anchor firmly to the photogenerating pigment surface, while the B segment functions as a steric stabilizer to prevent reflocculation of the photogenerating pigment after dispersion. More specifically, photogenerating hydroxygallium phthalocyanines, such as Type V (HOGaPc), dispersions generated with the A-B block copolymers of this invention are stable in excess of several months, for example in embodiments up to about 1 year. In addition, the block copolymers function both as the dispersant and the binder. Alternatively, the block copolymers of the present invention can be used in combination with a second compatible binder resin, such as a resin similar to the steric stabilizing block like polystyrene, and which binder resin is selected in an amount of from about 20 to about 80 weight percent.

In embodiments, the Type V hydroxygallium phthalocyanine photogenerating pigment can be prepared as illustrated in U.S. Pat. No. 5,482,811 the disclosure of which is totally incorporated herein by reference, and more specifically, by the formation of a precursor gallium phthalocyanine with, for example, an X-ray powder diffraction trace having peaks at Bragg angles of 7.6, 8.1, 9.7, 16.0, 18.4, 19.2, 19.9, 24.7, 25.7 and 26.2, and the highest peak at 8.1 degrees 2Θ, prepared by the reaction of 1,3-diiminoisoindolene with gallium acetylacetonate in a suitable solvent, such as N-methylpyrrolidone, or halonaphthalene like 1-chloronaphthalene, quinoline, and the like; hydrolyzing the precursor by dissolving in a strong acid and then reprecipitating the resulting dissolved pigment in aqueous ammonia, thereby forming Type I hydroxygallium phthalocyanine; and admixing the Type I formed with a hydrophobic solvent of, for example, hexanes, including n-hexane and/or isomers thereof, heptane, cyclohexane, cyclopentane or esters, such as propylacetate, butylacetate, or ketones such as methyl isobutyl ketone, methyl isoamyl ketone, or toluene, and thereafter, azeotropically removing water therefrom. More specifically, in embodiments the Type V process comprises the formation of a precursor prepared by the reaction of 1 part gallium acetylacetonate with from about 1 part to about 10 parts and preferably about 4 parts of 1,3-diiminoisoindolene in a solvent, such as quinoline, chloronaphthalene, or N-methylpyrrolidone, in an amount of from about 10 parts to about 100 parts and preferably about 19 parts, for each part of gallium acetylacetonate that is used, to provide a pigment precursor gallium phthalocyanine, which is subsequently washed with a component, such as dimethylformamide to provide the precursor gallium phthalocyanine as determined by X-ray powder diffraction, with an X-ray powder diffraction trace having peaks at Bragg angles of 7.6, 8.1, 9.7, 16.0, 18.4, 19.2, 19.9, 24.7, 25.7, and 26.2, and the highest peak at 8.1 degrees 2Θ; dissolving 1 weight part of the resulting gallium phthalocyanine in concentrated, about 94 percent, sulfuric acid in an amount of from about 1 weight part to about 100 weight parts and in an embodiment about 5 weight parts, by stirring the pigment precursor gallium phthalocyanine in the acid for an effective period of time, from about 30 seconds to about 24 hours, and in an embodiment about 2 hours at a temperature of from about 0° C. to about 75° C., and preferably about 40° C., in air or under an inert atmosphere, such as argon or nitrogen; adding the resulting mixture to a stirred organic solvent in a dropwise manner at a rate of about 0.5 milliliter per minute to about 10 milliliters per minute and in an embodiment about 1 milliliter per minute to a nonsolvent, which can be a mixture comprised of from about 1 volume part to about 10 volume parts and preferably about 4 volume parts of concentrated aqueous ammonia solution (14.8N) and from about 1 volume part to about 10 volume parts, and preferably about 7 volume parts of water, for each volume part of acid like sulfuric acid that was used, which solvent mixture was chilled to a temperature of from about −25° C. to about 10° C. and in an embodiment about −5° C. while being stirred at a rate sufficient to create a vortex extending to the bottom of the flask containing the solvent mixture; isolating the resulting blue pigment by, for example, filtration; and washing the hydroxygallium phthalocyanine product obtained with deionized water by redispersing and filtering from portions of deionized water, which portions are from about 10 volume parts to about 400 volume parts and in an embodiment about 200 volume parts for each weight part of precursor pigment gallium phthalocyanine selected. In further embodiments, there can be selected as a reactant an alkyoxygallium phthalocyanine dimer, reference copending patent applications U.S. Ser. No. 233,834, U.S. Pat. Nos. 5,466,796 and 5,456,998, the disclosures of which are totally incorporated herein by reference. In U.S. Pat. No. 3,473,064, the disclosure of which is totally incorporated herein by reference, there is illustrated a process for the preparation of hydroxygallium phthalocyanine Type V, essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts, with 1,3-diiminoisoindolene (DI3) in an amount of from about 1 part to about 10 parts, and preferably about 4 parts of DI3 for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example, from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts and preferably about 15 volume parts, for each weight part of pigment hydroxygallium phthalocyanine that is used by, for example, ball milling said Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours such that there is obtained a hydroxygallium phthalocyanine Type V, ball milling contains very low levels of residual chlorine of from about 0.001 percent to about 0.1 percent, and in an embodiment about 0.03 percent of the weight of the Type V hydroxygallium pigment, as determined by elemental analysis.

The Type V hydroxygallium phthalocyanine can be selected as organic photogenerator pigments in layered photoresponsive imaging members with charge transport layers, especially hole transport layers containing hole transport molecules such as known tertiary aryl amines. The aforementioned photoresponsive, or photoconductive imaging members can be negatively charged when the photogenerating layer is situated between the hole transport layer and the substrate, or positively charged when the hole transport layer is situated between the photogenerating layer and the supporting substrate. The layered photoconductive imaging members can be selected for a number of different known imaging and printing processes including, for example, electrophotographic imaging processes, especially xerographic imaging and printing processes wherein negatively charged or positively charged images are rendered visible using toner compositions of appropriate charge polarity. In general, the imaging members are sensitive in the wavelength region of from about 550 to about 900 nanometers, and in particular, from about 650 to about 850 nanometers, thus diode lasers can be selected as the light source.

In U.S. Pat. Nos. 5,384,223 and 5,384,222, the disclosures of which are totally incorporated herein by reference, there is illustrated a photoconductive imaging member comprised of a supporting substrate, a photogenerating layer comprised of photogenerating pigments dispersed in a polystyrene/polyvinyl pyridine ($A_n$-$B_m$) block copolymer wherein n represents the degree of polymerization of A, and m represents the degree of polymerization of B, and a charge transport layer, and wherein, for example, n is a number of from between about 7 to about 50, and A represents the anchoring block for said pigments, and B represents the block that functions primarily as a steric stabilizer; and wherein m is a number of from between about 70 to about 800; and a process for the preparation of a photogenerating composition which comprises mixing titanyl phthalocyanine Type IV, or BZP with the AB block copolymer polystyrene-b-poly(4-vinyl pyridine) in a suitable solvent. Examples of block copolymers disclosed in these copending applications include those wherein A is a basic anchoring group, such as poly(2-vinylpyridine), poly(4-vinylpyridine), poly[p-(dimethylamino methyl)styrene], or poly[2-(dimethylamino)ethyl methacrylate], and the B block is a polystyrenic, polydiene, or polymethacrylate, such as polystyrene/poly(4-vinylpyridine), with a molecular weight of from about 11,000 to about 35,000. In contrast to the preferred use of basic anchoring groups with BZP, we have found that use of an acidic anchoring group with HOGaPc provides exceptional stability of the copolymer/HOGaPc coating dispersion with respect to settling, with no reduction in sensitivity and excellent cycling behavior. Therefore, the binders of U.S. Pat. Nos. 5,384,223 and 5,384,222 are inferior in some respects for use with HOGaPc.

The disclosures of all of the aforementioned publications, laid open applications, copending applications and patents are totally incorporated herein by reference.

SUMMARY OF THE INVENTION

It is an object of the present invention to provide binders for photoconductive components, such as photogenerating pigments like hydroxygallium phthalocyanine and imaging members thereof, with many of the advantages illustrated herein.

Another object of the present invention relates to the provision of improved layered photoresponsive imaging members with photosensitivity to visible and near infrared radiations.

A further object of the present invention relates to novel binders of polystyrene/poly(methacrylic acid) diblock copolymers.

In still a further object of the present invention there are provided photoresponsive imaging members with an aryl amine hole transport layer, and a photogenerator layer comprised of Type V hydroxygallium phthalocyanine pigment components dispersed in the diblock copolymers illustrated herein.

These and other objects of the present invention can be accomplished in embodiments thereof by the provision of certain resin binders, and more specifically, resin binders for photogenerating pigments. In embodiments, the resin binders are comprised of certain AB diblocks.

Examples of the invention block copolymers include polystyrene/poly(methacrylic acid) of the formula ($A_n$-$B_m$) wherein A is the anchoring block, B is the steric stabilizing block, and n and m represent the number of segments, wherein n is a number of from about 1 to about 50 and m is a number of from about 50 to about 700, such as methacrylic acid and styrene, respectively, with compositional ratios of the methacrylic acid to styrene in the range of from about 5/95 to about 30/70, and more preferably in the range of from about 8/92 to about 20/80. These copolymers have molecular weights in the range of from about 5,000 to about 100,000 with the preferred range being from about 15,000 to about 40,000.

Specific examples of block copolymers that may be selected for layered photoconductive imaging members of the present invention include styrene/methacrylic acid, and more specifically, polystyrene/poly(methacrylic acid), preferably with a $M_w$ of from about 9,000 to about 60,000 in embodiments, and a Mn preferably of about 8,000 to about 50,000. Alternative anchoring blocks to poly(methacrylic acid) include acidic blocks such as poly(acrylic acid), modified poly(glycidyl methacrylate), poly(4-styrenesulfonic acid), modified poly(allyl methacrylate), poly(4-vinylbenzoic acid), and polar neutral blocks such as poly(aryl vinylsulfone), poly(alkyl vinylsulfone), and poly(9-acryloylcarbazole). Alternative steric stabilizing blocks to polystyrene include poly(alkyl methacrylates), such as poly(methyl methacrylate), polybutadiene, poly(dienes), poly(alkylstyrenes), poly(styrene-co-butadiene), and copolymers thereof. The AB block copolymers are selected in various effective amounts, such as from about 15 to about 50, and preferably from about 20 to about 40 volume percent or volume of the photogenerating layer.

The block copolymers can be synthesized by anionic polymerization, reference the processes as illustrated in S. K. Varshney, Z. Gao, X. F. Zhong and A. Eisenberg, *Macromolecules*, 27, pages 1076 to 1082 (1994), the disclosure of which is totally incorporated herein by reference. Methacrylic acid monomer cannot be polymerized directly by anionic polymerization, therefore, t-butyl methacrylate is used as protected form thereof. For example, anionic polymerization of styrene-b-(t-butyl methacrylate) can be accomplished at a temperature of from about −30° C. to about −50° C. in the presence of lithium chloride in solvents like tetrahydrofuran (THF) by initiation of styrene monomer with the α-methylstyryl anion generated from a-methylstyrene and a component like n-butyllithium (n-BuLi). Reaction is essentially instantaneous to yield the polystyrene stabilizing block with molecular weights which are easily calculated from the ratio of the total weight of monomer to the number of moles of initiator, and are as indicated herein. The living polystyryl anions are then capped with a single unit of diphenylethylene to provide a more hindered initiator for the alkyl methacrylate. The resulting diphenylethylene anion is further reacted with t-butyl methacrylate to yield a precursor to the desired anchoring block. The reaction is quenched with a small quantity of methanol and precipitated into a 10-fold excess of methanol. After filtering and vacuum drying, the block copolymer is obtained as a white powder in, for example, 96 percent yield. One typical polystyrene/poly(t-butyl methacrylate) block copolymer contains 12 mol percent of poly(t-butyl methacrylate) and 88 mol percent of styrene, as determined by 1H NMR, and has a weight average molecular of 28,000 as determined by GPC. The poly(styrene)-b-poly(t-butyl methacrylate) copolymer is then refluxed in toluene, with a catalytic amount of p-toluenesulfonic acid monohydrate, to provide the desired poly(styrene)-b-poly(methacrylic acid) with essentially 100 percent hydrolysis of the t-butyl ester. This material is isolated from toluene solution by precipitation in methanol. Copolymers with narrow polydispersities, such as for example a molecular weight distribution ($M_w/M_n$) of less than about 1.2, and more specifically, from about 1.10 to about 1.4, can be achieved. Composition and molecular weight of the copolymers can be controlled and determined by the weight of monomers used in the reaction, and the stoichiometric ratio of the α-methylstyryl anion to the styrene and t-butyl methacrylate monomers.

Numerous different layered photoresponsive imaging members with the binders illustrated herein and photogenerating pigments dispersed therein, such as Type V hydroxygallium phthalocyanine, can be generated. In embodiments, thus the layered photoresponsive imaging members are comprised of a supporting substrate, a charge transport layer, especially an aryl amine hole transport layer, and situated therebetween a photogenerator layer comprised of Type V hydroxygallium phthalocyanine photogenerating pigment dispersed in the block copolymers illustrated herein. Another embodiment of the present invention is directed to positively charged layered photoresponsive imaging members comprised of a supporting substrate, a charge transport layer, especially an aryl amine hole transport layer, and as a top overcoating layer Type V hydroxygallium phthalocyanine pigment dispersed in the block copolymers illustrated herein. Moreover, there is provided in accordance with the present invention an improved negatively charged photoresponsive imaging member comprised of a supporting substrate, a thin, for example from about 200 to about 500 Angstroms, and preferably about 350 Angstroms, silane undercoat, a thin adhesive layer, for example about 500 Angstroms in thickness, Type V hydroxygallium phthalocyanine photogenerator dispersed in the block copolymers illustrated herein, and as a top layer aryl amine hole transporting molecules dispersed in a polymeric resinous binder such as polycarbonate.

The photoresponsive imaging members of the present invention can be prepared by a number of known methods, the process parameters and the order of coating of the layers being dependent on the member desired. The imaging members suitable for positive charging can be prepared by reversing the order of deposition of photogenerator and hole transport layers. The photogenerating and charge transport layers of the imaging members can be coated as solutions or dispersions onto selective substrates by the use of a spray coater, dip coater, extrusion coater, roller coater, wire-bar coater, slot coater, doctor blade coater, gravure coater, and the like, and dried at from 40 to about 200° C. for from 10 minutes to several hours under stationary conditions or in an air flow. The coating is accomplished to provide a final coating thickness of from 0.01 to about 30 microns after it has dried. The fabrication conditions for a given layer can be tailored to achieve optimum performance and cost in the final device.

Imaging members of the present invention are useful in various electrostatographic imaging and printing systems, particularly those conventionally known as xerographic processes. Specifically, the imaging members of the present invention are useful in xerographic imaging processes wherein the Type V hydroxygallium phthalocyanine pigment absorbs light of a wavelength of from about 650 to about 900 nanometers, and preferably from about 650 to about 800 nanometers. In these known processes, electrostatic latent images are initially formed on the imaging member followed by development, and thereafter transferring the image to a suitable substrate. Imaging members employing Type V hydroxygallium phthalocyanine photogenerator pigment of the present invention exhibit high photosensitivities, generally with $E_{1/2}$ of about 2.0 ergs/cm$^2$ or less, even when exposed to monochromatic radiation of about 700 to 800 nanometers. Moreover, the imaging members of the present invention can be selected for electronic printing processes with laser diode light sources and light emitting diode (LED) arrays which typically function at wavelengths of from 660 to about 830 nanometers.

One negatively charged photoresponsive imaging member of the present invention is comprised, in the order indicated, of a supporting substrate, an adhesive layer comprised, for example, of a polyester 49,000 available from Goodyear Chemical, a photogenerator layer comprised of Type V hydroxygallium phthalocyanine dispersed in a polystyrene-block-poly(methacrylic acid) copolymer binder, and which copolymer possesses, for example, a $M_w$ of 28,000 and a narrow $M_w/M_n$ of about 1.13, and a hole transport layer thereover comprised of N,N'-diphenyl-N,N'-bis(3-methyl phenyl)-1,1'-biphenyl-4,4'-diamine dispersed in a polycarbonate binder, and a positively charged photoresponsive imaging member comprised of a substrate, thereover a charge transport layer comprised of N,N'-diphenyl-N,N'-bis(3-methyl phenyl)-1,1'-biphenyl-4,4'-diamine dispersed in a polycarbonate binder, and a top photogenerator layer comprised of Type V hydroxygallium phthalocyanine dispersed in a polystyrene-block-poly(methacrylic acid) copolymer binder, and which copolymer possesses, for example, a $M_w$ of 28,000 and a narrow $M_w/M_n$ of about 1.1 to about 1.4.

Examples of substrate layers selected for the imaging members of the present invention can be opaque or substantially transparent, and may comprise any suitable material having the requisite mechanical properties. Thus, the substrate may comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and many have a number of many different configurations, such as for example a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on many factors, including economical considerations, thus this layer may be of substantial thickness, for example over 3,000 microns, or of minimum thickness providing there are no adverse effects on the system. In one embodiment, the thickness of this layer is from about 75 microns to about 300 microns.

With further regard to the imaging members, the photogenerator layer is preferably comprised of Type V hydroxygallium phthalocyanine dispersed in the invention diblock copolymers. Generally, the thickness of the photogenerator layer depends on a number of factors, including the thicknesses of the other layers and the amount of photogenerator material contained in this layer. Accordingly, this layer can be of a thickness of from about 0.05 micron to about 10 microns when the photogenerator composition, preferably comprised of dihydroxygallium phthalocyanine, is present in an amount of from about 5 percent to about 95 percent by volume. In embodiments, this layer is of a thickness of from about 0.25 micron to about 1 micron when the photogenerator composition is present in this layer in an amount of 30 to 75 percent by volume. The maximum thickness of this layer in embodiments is dependent primarily upon factors, such as photosensitivity, electrical properties and mechanical considerations. The photogenerator layer can be fabricated by coating a dispersion of Type V hydroxygallium phthalocyanine in a suitable solvent with the polymer binder material. The dispersion can be prepared by mixing and/or milling the Type V in equipment, such as paint shakers, ball mills, sand mills and attritors. Common grinding media, such as glass beads, steel balls or ceramic beads, may be used in this equipment. In embodiments of the present invention, it is desirable to select a coating solvent that does not disturb or adversely affect the other previously coated layers of the device. Examples of solvents that can be selected for use as coating solvents for the photogenerator layer are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, dichloroethane, tetrahydrofuran, dioxane, diethyl ether, dimethylformamide, dimethylacetamide, butyl acetate, ethyl acetate, methoxyethyl acetate, and the like.

The coating of the photogenerator layer in embodiments of the present invention can be accomplished with spray, dip or wire-bar methods such that the final dry thickness of the photogenerator layer is from 0.01 to 30 microns and preferably from 0.1 to 15 microns after being dried at 40 to 150° C. for 5 to 90 minutes.

As adhesives usually in contact with the supporting substrate, there can be selected various known substances inclusive of polyesters, polyamides, poly(vinyl butyral), poly(vinyl alcohol), polyurethane and polyacrylonitrile. This layer is of a thickness of from about 0.001 micron to about 1 micron. Optionally, this layer may contain conductive and nonconductive particles, such as zinc oxide, titanium dioxide, silicon nitride, carbon black, and the like, to provide, for example, in embodiments of the present invention desirable electrical and optical properties.

Aryl amines selected for the charge, and preferably the hole transporting layer, which generally is of a thickness of from about 5 microns to about 75 microns, and preferably of a thickness of from about 10 microns to about 40 microns, include molecules of the following formula

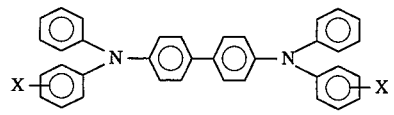

dispersed in a highly insulating and transparent polymer binder, wherein X is an alkyl group or a halogen, especially those substituents selected from the group consisting of Cl and $CH_3$.

Examples of specific aryl amines are N,N'-diphenyl-N,N'-bis(alkylphenyl)- 1,1-biphenyl-4,4'-diamine wherein alkyl is select the group consisting of methyl, ethyl, propyl, butyl, hexyl, and the like; and N,N'-diphenyl-N,N'-bis(h-alophenyl)-1,1'-biphenyl-4,4'-diamine wherein the halo substituent is preferably a chloro substituent. Other known charge transport layer molecules can be selected, reference for example U.S. Pat. Nos. 4,921,773 and 4,464,450, the disclosures of which are totally incorporated herein by reference.

Examples of the highly insulating and transparent polymer binder material for the transport layers include materials such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins having a molecular weight of from about 20,000 to about 100,000 with a molecular weight of from about 50,000 to about 100,000 being particularly preferred. Generally, the transport layer contains from about 10 to about 75 percent by weight of the charge transport material, and preferably from about 35 percent to about 50 percent of this material.

Also, included within the scope of the present invention are methods of imaging and printing with the photoresponsive devices illustrated herein. These methods generally involve the formation of an electrostatic latent image on the imaging member, followed by developing the image with a toner composition, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The xerographic electrical properties of the imaging members can be determined by known means, including as indicated herein electrostatically charging the surfaces thereof with a corona discharge source until the surface potentials, as measured by a capacitively coupled probe attached to an electrometer, attained an initial value $V_o$ of about −800 volts. After resting for 0.5 second in the dark, the charged members attained a surface potential of $V_{ddp}$, dark development potential. Each member was then exposed to light from a filtered Xenon lamp with a XBO 150 watt bulb, thereby inducing a photodischarge which resulted in a reduction of surface potential to a $V_{bg}$ value, background potential. The percent of photodischarge was calculated as $100\times(V_{ddp}-V_{bg})/V_{ddp}$. The desired wavelength and energy of the exposed light was determined by the type of filters placed in front of the lamp. The monochromatic light photosensitivity was determined using a narrow band-pass filter. The photosensitivity of the imaging members is usually provided in terms of the amount of exposure energy in ergs/cm$^2$, designated as $E_{1/2}$, required to achieve 50 percent photodischarge from the dark development potential. The higher the photosensitivity, the smaller is the $E_{1/2}$ value.

The following Examples are being submitted to illustrate embodiments of the present invention. These Examples are intended to be illustrative only and are not intended to limit the scope of the present invention. Also, parts and percentages are by weight unless otherwise indicated. Comparative Examples are also provided.

SYNTHESIS OF DIBLOCK COPOLYMERS

General Experimental:

All syringes and syringe needles were dried in an oven at 125° C., and cooled in a desiccator containing calcium chloride. Tetrahydrofuran was dried over and distilled from sodium/benzophenone under an argon atmosphere. Styrene, α-methylstyrene, 4-vinylpyridine, 4-(dimethylaminomethyl) styrene and 1,1-diphenylethylene were vacuum distilled from sodium hydride and stored under a blanket of argon. t-Butyl methacrylate and t-butyl acrylate were vacuum distilled from calcium hydride followed by vacuum distillation from triethylaluminum and stored under a blanket of argon. n-Butyllithium in cyclohexane, was used as received from Aldrich Chemical and titrated with diphenylacetic acid, just prior to use. All reactions were accomplished using a Buchi Type 1 Autoclave fitted with a 0.5 liter kettle. The reaction kettle was flushed with argon gas and dried using a solution of n-butyllithium. Throughout the synthesis of the copolymer, a positive pressure of argon was maintained in the reaction kettle.

EXAMPLE I

PREPARATION OF POLYSTYRENE-B-POLY(T-BUTYL METHACRYLATE) COPOLYMERS:

(i) Preparation of Polystyrene-b-poly(t-butyl methacrylate) Copolymers:

To the reactor kettle WERE added dry tetrahydrofuran (200 milliliters) and lithium chloride (750 milligrams, 17.7 millimols) followed by cooling to a bath temperature of −50° C. The initiator solution was prepared in a separate pot by the dropwise addition of n-butyllithium (1.8 milliliters, 3.33 millimols) to a-methylstyrene (0.52 milliliter, 4.0 millimols) in tetrahydrofuran (10 milliliters). Without delay, a portion of the deep red initiator solution (8.1 milliliters, 2.2 millimols) was transferred to the reaction kettle followed by styrene monomer (28.5 grams, 273 millimols). There was an immediate color change from red to orange. After 15 minutes, 1,1-diphenylethylene (0.5 gram, 2.8 millimols) was added to provide a blood red solution. After an additional 15 minutes, t-butyl methacrylate monomer (5.4 grams, 38 millimols) was added to provide a very pale yellow solution. The bath temperature was maintained at −50° C. for one hour and then the reaction was quenched with methanol (0.5 milliliter). The block copolymer was isolated by precipitation into 2 liters of methanol. The product was collected by filtration and dried to constant weight in a vacuum oven at 60° C. to provide a 96 percent yield.

(ii) Conversion of Polystyrene-b-poly(t-butyl Methacrylate) Copolymers to Polystyrene-b-poly(methacrylic acid) Copolymers:

Polystyrene-b-poly(t-butyl methacrylate) copolymer (5 grams) was dissolved in toluene (100 milliliters). p-Toluenesulfonic acid monohydrate (125 milligrams, 2.5 percent by weight) was then added and the resulting mixture was heated at reflux for 5 hours. The methacrylic acid containing copolymer was isolated by precipitation of the mixture into 1 liter of methanol.

(iii) Characterization of Polystyrene-b-poly(Methacrylic Acid) Copolymers:

Poly(methacrylic acid) and polystyrene contents were easily identified by $^1$H and $^{13}$C NMR, and $M_n$ and $M_w$ were determined by GPC versus polystyrene standards. For the above described copolymer, the methacrylic acid and styrene contents were 12 mol percent and 88 mol percent, respectively. The polystyrene-b-poly(t-butyl methacrylate) copolymer had a $M_n$=24,994 and a $M_w$=28,091, indicating a very narrow polydispersity of 1.12 was obtained. After hydrolysis of the t-butyl ester to the carboxylic acid, the $M_w$ was reduced to 24,200.

EXAMPLE II

PREPARATION AND CHARACTERIZATION OF POLYSTYRENE-B-POLY(ACRYLIC ACID) COPOLYMERS:

The procedure for the synthesis and characterization of polystyrene-b-poly(acrylic acid) copolymers was identical to that described above for the analogous methacrylic acid containing materials. More specifically, the polystyrene-b-poly(acrylic acid) copolymer of Example II contains 12 mol percent poly(acrylic acid), 88 mole percent polystyrene and has a $M_w$ of 22,300.

CONTROL EXAMPLE III

Control Example III utilizes a commercially available polyvinylbutyral binder resin referred to as PVB (BMS®). Prior to the synthesis of the above-described materials, it was a benchmark against which new binder polymers were evaluated.

Comparative Example IV

PREPARATION AND CHARACTERIZATION OF POLYSTYRENE-B-POLY(4-VINYLPYRIDINE) COPOLYMERS:

The procedure for the synthesis and characterization of polystyrene-b-poly(4-vinylpyridine) copolymers was the same as that described above for polystyrene-b-poly(t-butyl methacrylate) with two exceptions. Lithium chloride and 1,1-diphenylethylene were omitted since they were not necessary to the success of the polymerization. More specifically, the copolymer of Example IV contains 11 mol percent poly(4-vinylpyridine), 89 mole percent polystyrene and has a $M_w$ of 23,800.

Comparative Example V

PREPARATION AND CHARACTERIZATION OF POLYSTYRENE-B-POLY[4-(DIMETHYLAMINOMETHYL) STYRENE]COPOLYMERS:

The procedure for the synthesis and characterization of polystyrene-b-poly[4-(dimethylaminomethyl) styrene]copolymers was identical to that described above in Example IV for the 4-vinylpyridine containing materials. More specifically, the polystyrene-b-poly(4-vinylpyridine) copolymer of Example V contains 10 mol percent poly[4-(dimethylaminomethyl) styrene] and 90 mole percent polystyrene and has a $M_w$ of 10,100.

SYNTHESIS OF TYPE V GALLIUM PHTHALOCYANINE:

Alkoxy-bridged Gallium Phthalocyanine Dimer Synthesis Using Gallium Methoxide Obtained From Gallium Chloride and Sodium Methoxide In Situ:

To a 1 liter round bottomed flask were added 25 grams of $GaCl_3$ and 300 milliliters of toluene, and the mixture was stirred for 10 minutes to form a solution. Then, 98 milliliters of a 25 weight percent sodium methoxide solution (in methanol) were added while cooling the flask with an ice bath to keep the contents below 40° C. Subsequently, 250 milliliters of ethylene glycol and 72.8 grams of o-phthalodinitrile were added. The methanol and toluene were quickly distilled off over 30 minutes while heating from 70 to 135° C., and then the phthalocyanine synthesis was performed by heating at 195° C. for 4.5 hours. The alkoxy-bridged gallium phthalocyanine dimer was isolated by filtration at 120° C. The product was then washed with 400 milliliters of DMF at 100° C. for 1 hour and filtered. The product was then washed with 600 milliliters of deionized water at 60° C. for 1 hour and filtered. The product was then washed with 600 milliliters of methanol at 25° C. for 1 hour and filtered. The product was dried at 60° C. under vacuum for 18 hours. The alkoxy-bridged gallium phthalocyanine dimer, 1,2-di(oxogallium phthalocyaninyl) ethane, was isolated as a dark blue solid in 77 percent yield. The dimer product was characterized by elemental analysis, infrared spectroscopy, $^1H$ NMR spectroscopy and X-ray powder diffraction. Elemental analysis showed the presence of only 0.10 percent chlorine. Infrared spectroscopy: major peaks at 573, 611, 636, 731, 756, 775, 874, 897, 962, 999, 1069, 1088, 1125, 1165, 1289, 1337, 1424, 1466, 1503, 1611, 2569, 2607, 2648, 2864, 2950, and 3045 $cm^{-1}$; $^1H$ NMR spectroscopy (TFA-d/$CDCl_3$ solution, 1:1 v/v, tetramethylsilane reference): peaks at (δ, ppm±0.01 ppm) 4.00 (4H), 8.54 (16H), and 9.62 (16H); X-ray powder diffraction pattern: peaks at Bragg angles (2Θ±0.2°) of 6.7, 8.9, 12.8, 13.9, 15.7, 16.6, 21.2, 25.3, 25.9, and 28.3 with the highest peak at 6.7 degrees 2Θ.

Hydrolysis of Alkoxy-bridged Gallium Phthalocyanine to Hydroxygallium Phthalocyanine (Type I):

The hydrolysis of the above alkoxy-bridged gallium phthalocyanine to hydroxygallium phthalocyanine was performed as follows. Sulfuric acid (94 to 96 percent, 125 grams) was heated to 40° C. in a 125 milliliter Edenmeyer flask, and then 5 grams of the chlorogallium phthalocyanine were added. Addition of the solid was completed in approximately 15 minutes, during which time the temperature of the solution increased to about 48° C. The acid solution was then stirred for 2 hours at 40° C., after which it was added in a dropwise fashion to a mixture comprised of concentrated (~30 percent) ammonium hydroxide (265 milliliters) and aleionized water (435 milliliters), which had been cooled to a temperature below 5° C. The addition of the dissolved phthalocyanine was completed in approximately 30 minutes, during which time the temperature of the solution increased to about 40° C. The reprecipitated phthalocyanine was then removed from the cooling bath and allowed to stir at room temperature for 1 hour. The resulting phthalocyanine was then filtered through a porcelain funnel fitted with a Whatman 934-AH grade glass fiber filter. The resulting blue solid was redispersed in fresh aleionized water by stirring at room temperature for 1 hour and filtered as before. This process was repeated at least three times until the conductivity of the filtrate was <20 μS. The filtercake was oven dried overnight at 50° C. to give 4.75 grams (95 percent) of Type I HOGaPc, identified by infrared spectroscopy and X-ray powder diffraction. Infrared spectroscopy: major peaks at 507, 573, 629, 729, 756, 772, 874, 898, 956, 984, 1092, 1121, 1165, 1188, 1290, 1339, 1424, 1468, 1503, 1588, 1611, 1757, 1835, 1951, 2099, 2207, 2280, 2384, 2425, 2570, 2608, 2652, 2780, 2819, 2853, 2907, 2951, 3049 and 3479 (broad) $cm^{-1}$; X-ray diffraction pattern: peaks at Bragg angles of 6.8, 13.0, 16.5, 21.0, 26.3 and 29.5 with the highest peak at 6.8 degrees 2Θ (2 theta±0.2°).

Conversion of Type I Hydroxygallium Phthalocyanine to Type V:

The Type I hydroxygallium phthalocyanine pigment obtained above was converted to Type V HOGaPc as follows. The Type I hydroxygallium phthalocyanine pigment (3.0 grams) was added to 25 milliliters of N,N-dimethylformamide in a 60 milliliter glass bottle containing 60 grams of glass beads (0.25 inch in diameter). The bottle was sealed and placed on a ball mill overnight (18 hours). The solid was isolated by filtration through a porcelain funnel fitted with a Whatman GF/F grade glass fiber filter, and washed in the filter using several 25 milliliter portions of acetone. The filtered wet cake was oven dried overnight at 50° C. to provide 2.8 grams of Type V HOGaPc, which was identified by infrared spectroscopy, and X-ray powder diffraction. Infrared spectroscopy: major peaks at 507, 571, 631, 733, 756, 773, 897, 965, 1067, 1084, 1121, 1146, 1165, 1291, 1337, 1425, 1468, 1503, 1588, 1609, 1757, 1848, 1925, 2099, 2205, 2276, 2384, 2425, 2572, 2613, 2653, 2780, 2861, 2909, 2956, 3057 and 3499 (broad) $cm^{-1}$; X-ray diffraction pattern: peaks at Bragg angles of 7.4, 9.8, 12.4, 12.9, 16.2, 18.4, 21.9, 23.9, 25.0 and 28.1 with the highest peak at 7.4 degrees 2Θ (2 theta ±0.2°).

DEVICE FABRICATION AND EVALUATION:

Hydroxygallium phthalocyanine Type V, as described above, dispersed in the above Example, resin binders can be selected as photogenerating layers for layered photoconductive imaging members, including Devices 1 through 15 (see Tables 1 and 2), which devices were prepared as follows. A titanized MYLAR® substrate of 75 microns was coated with a silane layer (gamma-aminopropyl methyl diethoxysilane) 0.1 micron in thickness followed by a polyester adhesive layer thereon in a thickness of 0.1 micron. A dispersion of hydroxygallium Type V phthalocyanine (HOGaPe) Type V was prepared by combining 0.50 gram of the HOGaPc, and 0.26 gram of one of the above prepared copolymers, for example, polystyrene-block-poly(methacrylic acid) with a $M_w$ of 24,200 with chlorobenzene (23 milliliters) in a 60 milliliter glass jar containing 70 grams of 0.8 millimeter glass beads. The resulting dispersion was shaken on a paint shaker for 2 hours then was coated onto the adhesive/silane layer described above using a number 6 wire wound applicator. The formed photogenerating layer HOGaPc Type V was dried at 100° C. for 10 minutes to a final thickness of about 0.20 micron.

A hole transporting layer solution was prepared by dissolving 6.34 grams of N,N'-diphenyl-N,N-bis(3-methyl phenyl)-1,1'-biphenyl-4,4'-diamine, and 6.34 grams of polycarbonate in 72 grams of dichloromethane. The solution was coated onto the HOGaPc Type V generator layer using a 10 mil film applicator. The charge transporting layer thus obtained was dried at 115° C. for 60 minutes to provide a final thickness of about 27 microns.

In a cycling test, the devices or imaging members were charged with a corotron to about −800 volts. They were exposed with 775 nanometers of light with an intensity of about 7 ergs/$cm^2$ and erased with white light of about 60 ergs/$cm^2$. The dark development ($V_{ddp}$) and background ($V_{bg}$) potentials were measured and recorded, while the testing was performed for 10,000 cycles. The devices were mounted on a drum housed in a controlled environmental chamber. During the cycling tests, the chamber is operated at 20° C., 40 percent RH. Changes in the dark development potential $\Delta V_{ddp}$ and background potential $\Delta V_{ddp}$ are determined after the cycling test. After the cycling test had been completed, the devices were remained in the darkened drum scanner for about 20 hours. Subsequent to charging the devices to about −800 volts with a corotron, they were exposed with 775 nanometers of light with an intensity of 3 ergs/$cm^2$ and erased with white light of about 200 ergs/$cm^2$. The dark development and background potentials were measured, and recorded while the testing was performed for 5,000 cycles. The significantly higher erase light intensity, used in this second test compared to the standard test, accelerates the cycledown (decrease in the dark development potential) in the photogenerator material, and is thus considered a stress test.

The xerographic electrical properties of photoresponsive imaging members prepared as described above were determined by electrostatically charging the surface thereof with a corona discharge source until the surface potential, as measured by a capacitatively coupled probe attached to an electrometer, attained an initial dark value, $V_0$, of −800 volts. After resting for 0.5 second in the dark, the charged member reached a surface potential, $V_{ddp}$, or dark development potential. The member was then exposed to filtered light from a Xenon lamp. A reduction in surface potential from $V_{ddp}$ to a background potential, $V_{bg}$, due to the photodischarge effect was observed. The dark decay in volts per second was calculated as $(V_0-V_{ddp})/0.5$. The percent of photodischarge was calculated as $100\times(V_{ddp}-V_{bg})/V_{ddp}$. The half exposure energy, that is $E_{1/2}$, is the amount of exposure energy causing reduction of the $V_{ddp}$ to half of its initial value, was determined. The wavelength of light selected was 780 nanometers.

RESULTS AND DISCUSSION:

The devices were evaluated according to the film quality of the binder generator layer, tendency of the hydroxygallium phthalocyanine dispersion to settle over time, and electrical performance of the photoreceptor device. To determine the quality of the dry BGL film, the dispersion was coated on a MYLAR® substrate and observed both visually and under a microscope. Visual inspection revealed the overall film homogeneity and appearance (e.g. smooth or orange peel); and microscopic observation revealed whether the film was continuous or contained defects such as voids, streaks, and aggregrates. The film was deemed to be acceptable or good if it was free of the above mentioned defects. Dispersion quality was measured using a capillary flow technique where the dispersion was allowed to flow through a small gap (−1 mil) between 2 glass slides. The flow was viewed under a microscope and was classified as "good" if it was free of aggregation and flowed to the end of the slide. The dispersion stability was measured by allowing the dispersions to sit unagitated and examining for sediment at regular time intervals (days, months). Dispersion stability was considered excellent for samples free of sedimentation for several months and equivalent to the PVB (BMS®) control samples if they settled within 48 hours. In addition, it was critical that use of this dispersant as the binder polymer in the BGL did not degrade the electrical properties of the photoreceptor, for example the sensitivity, dark decay, residual voltage and the ability to charge to 800 volts.

Device 11 (see Tables 1 and 2) was coated using a commercially available polyvinyl butyral resin in chlorobenzene. It was used as a Control Device primarily since its performance as a photogenerator binder for hydroxygallium phthalocyanine was excellent. Although Device 11 shows very good electrical performance and acceptable film quality, the hydroxygallium phthalocyanine dispersion in PVB (BMS®) is rather unstable and settles in less than 2 days.

Comparative Example IV which uses the polystyrene-b-poly(4-vinylpyridine) of the type disclosed in U.S. Pat. No. 5,384,223 provides similar results to that of the Control Example III. However, the devices of Comparative Example IV are considered to be superior to the PVB (BMS®) devices with respect to number of coating defects and environmental stability.

In Examples I and II, diblock copolymers containing an acidic anchoring group, poly(methacrylic acid) and poly(acrylic acid), respectively, have been utilized. The stability of the resulting hydroxygallium phthalocyanine dispersion is solvent dependent with chlorinated solvents providing superior stability as demonstrated by Devices 1 and 2, and 6 and 7 (see Table 2). Toluene dispersions provide intermediate stability (1 to 2 months) while butylacetate and tetrahydrofuran provide relatively unstable dispersions (2 days). The dispersions in the chlorinated solvent have been stable for five months thus far and this test continues. In addition, there is no degradation of the electrical performance or cyclic stability of the photoreceptor as illustrated in Tables 1 and 3.

Comparative Example V containing polystyrene-b-poly [4-(dimethylaminomethyl) styrene] provided poor film quality with microscopic examination revealing the presence of voids, and unacceptable discharge properties with residual voltages in the range of 50 to 60 volts.

Large pigment particles (>1 micron) due to inefficient grinding or reflocculation are undesirable since they result in coating defects which subsequently surface as print defects. Preferably, the pigment particle size should be below 0.1 micron. The more stable the coating dispersion the more likely it is that a homogeneous binder generator layer will result. Therefore, it is of importance that the dispersion once formed remain stable with respect to settling and reflocculation to allow completion of the coating. Coating dispersions containing the block copolymer of the present invention as the binder/dispersant for hydroxygallium phthalocyanine have shown superior stability. In particular, block copolymers of polystyrene with poly(acrylic acid) or poly(methacrylic acid), such as illustrated in Examples I and II have proven to be excellent choices, provided the solvent is chosen correctly. Chlorinated solvents, such as chlorobenzene, dichloromethane and dichloroethane, have provided superior dispersions, and toluene has provided somewhat less of an improvement in dispersion stability but nevertheless greatly improved over Example III, containing the control binder resin, and Example IV, containing the polystyrene-b-poly(4-vinylpyridine) copolymers of the prior art. In particular, Devices 1, 2, 3, 6, 7 and 8 are the only examples which satisfy the three criteria of film quality, dispersion stability and electrical performance. Compared to Comparative Example IV (Devices 12 and 13) of the prior art, an improvement in the dispersion stability is illustrated with the present invention.

TABLE 1

| | | | P/R Device Electrical Performance | | | | | |
|---|---|---|---|---|---|---|---|---|
| EXAMPLE NO. | Solvent | Device No. | DARK DECAY (V/s) | S ($V \cdot cm^2/erg$) | $E_{1/2}$ ($ergs/cm^2$) | $V_{res}$ (–V) | Corotron Voltage (kV) | $V_{ddp}$ (volts) |
| Example I | Chlorobenzene | 1 | 11.6 | 291 | 1.51 | 2.2 | –5.16 | 809 |
| Example I | Dichloromethane | 2 | 16.2 | 283 | 1.55 | 3.2 | –5.23 | 812 |
| Example I | Toluene | 3 | 13.1 | 259 | 1.58 | 2.2 | –5.22 | 809 |
| Example I | THF | 4 | 17.7 | 235 | 1.96 | 7.2 | –5.29 | 813 |
| Example I | Butylacetate | 5 | 11.4 | 281 | 1.58 | 6.1 | –5.22 | 809 |
| Example II | Chlorobenzene | 6 | 4.8 | 269 | 1.61 | 0.12 | –5.21 | 805 |
| Example II | Dichloromethane | 7 | 10.0 | 244 | 1.74 | 3.1 | –5.13 | 805 |
| Example II | Toluene | 8 | 8.8 | 281 | 1.52 | 0.13 | –5.20 | 806 |
| Example II | THF | 9 | 45 | 248 | 1.76 | 10.2 | –5.36 | 830 |
| Example II | Butylacetate | 10 | 21 | 291 | 1.53 | 7.2 | –5.20 | 812 |
| Control Example III | Chlorobenzene | 11 | 8.0 | 286 | 1.69 | 6.2 | –5.40 | 806 |
| Comparative Example IV | Chlorobenzene | 12 | 6.4 | 266 | 1.61 | 13.3 | –5.47 | 804 |
| Comparative Example IV | Toluene | 13 | 23 | 267 | 1.67 | 10.2 | –5.55 | 808 |
| Comparative Example V | Chlorobenzene | 14 | 0.8 | 245 | 1.83 | 51 | –5.20 | 802 |
| Comparative Example V | Toluene | 15 | 1.6 | 204 | 2.40 | 60 | –5.17 | 805 |

TABLE 2

| | | | Hydroxygallium Phthalocyanine/Binder Resin Dispersion Stability and Film Quality | | | |
|---|---|---|---|---|---|---|
| EXAMPLE | Device | | Dispersion | Time for | Film Quality | |
| NO. | No. | Solvent | Quality | Sedimentation | Visual | Microscope |
| Example I | 1 | Chlorobenzene | good | >5 months | good | good |
| Example I | 2 | Dichloromethane | good | >5 months | good | good |
| Example I | 3 | Toluene | good | four weeks | good | good |
| Example I | 4 | THF | poor | 48 hours | poor | poor |
| Example I | 5 | Butylacetate | poor | 48 hours | good | good |

TABLE 2-continued

| Hydroxygallium Phthalocyanine/Binder Resin Dispersion Stability and Film Quality | | | | | | |
|---|---|---|---|---|---|---|
| EXAMPLE | Device | | Dispersion | Time for | Film Quality | |
| NO. | No. | Solvent | Quality | Sedimentation | Visual | Microscope |
| Example II | 6 | Chloro-benzene | good | >3 months | good | good |
| Example II | 7 | Dichloro-methane | good | >3 months | good | good |
| Example II | 8 | Toluene | good | >2 months | good | good |
| Example II | 9 | THF | good | 4 days | good | good |
| Example II | 10 | Butyl-acetate | good | 4 days | good | good |
| Control Example III | 11 | Chloro-benzene | poor | 48 hours | good | good |
| Comparative Example IV | 12 | Chloro-benzene | poor | 48 hours | good | good |
| Comparative Example IV | 13 | Toluene | poor | 48 hours | good | good |
| Comparative Example V | 14 | Chloro-benzene | poor | | good | poor |
| Comparative Example V | 15 | Toluene | poor | | poor | poor |

TABLE 3

| Xerographic Cycling Evaluations | | | | | | |
|---|---|---|---|---|---|---|
| | 10K Cycling Test | | | 5K Cycling Stress Test | | |
| Example No. | $\Delta V_{ddp}$ | $\Delta V_{res}$ | $V_{res}$ | $\Delta V_{ddp}$ | $\Delta V_{res}$ | $V_{res}$ |
| Example I | −14 | 13 | 7 | −28 | 2 | 4 |
| Control Example III | −23 | 1 | 26 | −40 | 2 | 17 |

Other embodiments and modifications of the present invention may occur to those of ordinary skill in the art subsequent to a review of the present application and the information presented herein; these embodiments and modifications, as well as equivalents thereof, are also included within the scope of this invention.

What is claimed is:

1. A photoconductive imaging member comprised of a supporting substrate, photogenerating layer comprised of a hydroxygallium phthalocyanine photogenerating pigment dispersed in a binder of polystyrene/poly(methacrylic acid) ($A_n$-$B_m$) block copolymer wherein A is the anchoring block, B is the steric stabilizing block, and n and m represent the number of segments; and a charge transport layer.

2. A member in accordance with claim 1 wherein n is a number of from 1 to about 50, and m is a number of from about 50 to 800.

3. A member in accordance with claim 1 wherein n is a number of from 10 to about 20, and m is a number of from about 110 to 350.

4. A member in accordance with claim 1 wherein the weight average molecular weight of said block copolymer is from about 5,000 to about 100,000.

5. A member in accordance with claim 1 wherein the weight average molecular weight of said block copolymer is from about 15,000 to about 40,000.

6. A member in accordance with claim 3 wherein the weight average molecular weight of said block copolymer is from about 15,000 to about 40,000.

7. A member in accordance with claim 1 wherein A is methacrylic acid, and B is styrene.

8. A member in accordance with claim 3 wherein A is methacrylic acid, and B is styrene.

9. A member in accordance with claim 7 wherein the compositional ratios of the poly(methacrylic acid) to polystyrene is in the range of from about 5/95 to about 30/70.

10. A member in accordance with claim 7 wherein the compositional ratios of the poly(methacrylic acid) to polystyrene is in the range of from about 8/92 to about 20/80.

11. A member in accordance with claim 1 wherein said block copolymer is polystyrene/poly(acrylic acid).

12. A member in accordance with claim 2 wherein said block copolymer is polystyrene/poly(methacrylic acid).

13. A member in accordance with claim 1 wherein said block copolymer is polystyrene/poly(methacrylic acid) with a weight average molecular weight, $M_w$, of from about 9,000 to about 60,000.

14. A member in accordance with claim 1 wherein said block copolymer is polystyrene/poly(methacrylic acid) with a number average molecular weight, $M_n$, of from about 8,000 to about 50,000.

15. A member in accordance with claim 1 wherein said block copolymer is polystyrene/poly(methacrylic acid) with a weight average molecular weight, $M_w$, of from about 9,000 to about 60,000, and a number average molecular weight, $M_n$, of from about 8,000 to about 50,000.

16. A member in accordance with claim 1 wherein the A anchoring block for said block copolymer is poly(acrylic acid), poly(4-styrenesulfonic acid), poly(4-vinylbenzoic acid), or polar neutral blocks of poly(aryl vinylsulfone), poly(alkyl vinylsulfone), or poly(9-acryloylcarbazole); and the steric stabilizing B block is poly(methyl methacrylate), polybutadiene, poly(dienes), poly(alkylstyrenes), poly(styrene-co-butadiene), or copolymers thereof.

17. A member in accordance with claim 1 wherein said block copolymer is selected in an amount of from about 15 to about 50 volume percent based on the dried mixture of said block copolymer and said pigments, or said pigment, and wherein said copolymer functions as a binder resin for said pigment, or said pigments.

18. A photoconductive imaging member in accordance with claim 1 wherein the charge transport layer is comprised of hole transport compounds.

19. A photoconductive imaging member in accordance with claim 1 wherein the photogenerating layer is in contact with and is situated between the supporting substrate and the charge transport layer.

20. A photoconductive imaging member in accordance with claim 1 wherein the charge transport layer is in contact with and is situated between the supporting substrate and the photogenerating layer.

21. A photoconductive imaging member in accordance with claim 1 wherein the photoconductive imaging member includes a metal oxide hole blocking layer in contact with and situated between the supporting substrate and the photogenerating layer.

22. A photoconductive imaging member in accordance with claim 21 wherein the metal oxide is aluminum oxide.

23. A photoconductive imaging member in accordance with claim 22 wherein the photoconductive imaging member contains an adhesive interface layer in contact with and situated between the supporting substrate and the metal oxide hole blocking layer.

24. A photoconductive imaging member in accordance with claim 1 wherein the supporting substrate is a metal of aluminum, titanium, or chromium, or an organic polymeric composition.

25. A photoconductive imaging member in accordance with claim 1 wherein the charge transport layer is comprised of aryl amine molecules of the formula

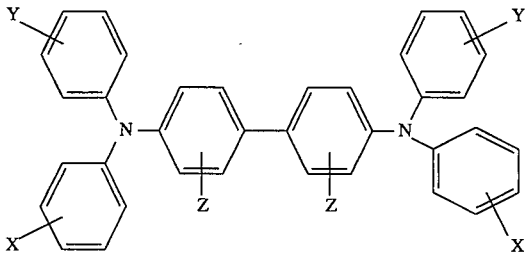

dispersed in an organic resinous binder wherein X, Y and Z are selected from the group consisting of hydrogen, an alkyl group with from 1 to about 25 carbon atoms and a halogen, and at least one of X, Y and Z is independently an alkyl group or a halogen.

26. A photoconductive imaging member in accordance with claim 25 wherein the resinous binder is a polycarbonate, and wherein said block copolymer is polystyrene/poly(methacrylic acid).

27. A method of imaging comprising the steps of (a) generating an electrostatic image on the photoconductive imaging member of claim 1;

(b) subsequently developing the electrostatic image;

(c) transferring the developed electrostatic image to a suitable substrate; and (d) permanently affixing the transferred image to the substrate.

28. A photoconductive imaging member comprised of a photogenerating layer comprised of a hydroxygallium phthalocyanine photogenerating pigment dispersed in a polystyrene/poly(methacrylic acid) ($A_n$-$B_m$) block copolymer resin binder wherein A is the anchoring block, B is the steric stabilizing block, and n and m represent the number of segments; and a charge transport layer.

29. A photoconductive imaging member comprised of a supporting substrate, a photogenerating layer comprised of a hydroxygallium phthalocyanine Type V photogenerating pigment dispersed in a polystyrene/poly(methacrylic acid) ($A_n$-$B_m$) block copolymer wherein A is the anchoring block, B is the steric stabilizing block, and n and m represent the number of segments; and a charge transport layer.

30. An imaging member in accordance with claim 29 wherein n is a number of from 1 to about 50 and m is a number of from about 50 to 800.

31. An imaging member in accordance with claim 29 wherein the weight average molecular weight of said block is from about 5,000 to about 100,000.

32. An imaging member in accordance with claim 29 wherein a is methacrylic acid and b is styrene.

* * * * *